United States Patent [19]

Blake

[11] Patent Number: 4,982,900

[45] Date of Patent: Jan. 8, 1991

[54] TRIGGER SPRAYER

[76] Inventor: William S. Blake, 14 Georgetown Ct., Linwood, N.J. 08221

[21] Appl. No.: 453,003

[22] Filed: Jan. 24, 1990

Related U.S. Application Data

[63] Continuation of Ser. No. 194,296, May 16, 1988, abandoned.

[51] Int. Cl.[5] ..... B05B 9/043

[52] U.S. Cl. ..... 239/333; 234/570; 234/575; 234/581.2; 222/383; 222/402

[58] Field of Search ..... 222/383–385, 222/153, 402, 14, 24; 239/324, 330, 333, 570, 575, 576, 590, 533.13

[56] References Cited

U.S. PATENT DOCUMENTS

| | | | |
|---|---|---|---|
| 384,306 | 6/1888 | Bardil | 239/533.3 X |
| 2,715,580 | 8/1955 | Frick | 137/853 X |
| 3,276,641 | 10/1966 | Lehmann | 222/384 X |
| 3,632,042 | 4/1972 | Kirsh | 137/853 |
| 3,804,302 | 7/1974 | Yamada et al. | 222/402.14 X |
| 4,034,900 | 7/1977 | Hafale | 239/333 X |
| 4,161,288 | 7/1979 | McKinney | 222/385 X |
| 4,262,823 | 4/1981 | Monden | 222/321 |
| 4,530,449 | 7/1985 | Nozawa et al. | 239/333 X |
| 4,596,344 | 6/1988 | Corsette | 239/333 X |
| 4,702,419 | 10/1989 | Luchsinger | 239/333 |

FOREIGN PATENT DOCUMENTS

| | | | |
|---|---|---|---|
| 1036993 | 8/1978 | Canada | 239/333 |

*Primary Examiner*—Andres Kashnikow
*Assistant Examiner*—Kevin Weldon
*Attorney, Agent, or Firm*—Dennis H. Lambert

[57] ABSTRACT

A dual function trigger sprayer in which a pump housing is formed with fastening means thereon to secure the housing to a shroud, and has structure at opposite ends defining an inlet chamber and an outlet chamber, respectively. A double ended piston is reciprocable in the housing to effect dispensing of product from a container on which the sprayer is attached, and an outlet valve controls flow from the outlet chamber. A passageway extends through the piston to enable flow between the inlet and outlet chambers, and a restrictor is associated with the passageway to restrict flow between the chambers in such a way that a relatively slow actuation of the piston will result in product flowing from the outlet chamber back into the inlet chamber, defining a child safety feature. Relatively firm, rapid actuation of the piston, on the other hand, will cause the outlet value to open for dispensing of product. The housing, piston and restrictor may be preassembled as a subassembly for inventory and subsequent assembly with a shroud and actuator. Several unique nose piece valve constructions are also disclosed, and a filter is disposed between the outlet valve and the nozzle to filter particulate matter from the product to prevent blockage of the nozzle.

33 Claims, 8 Drawing Sheets

FIG. 2
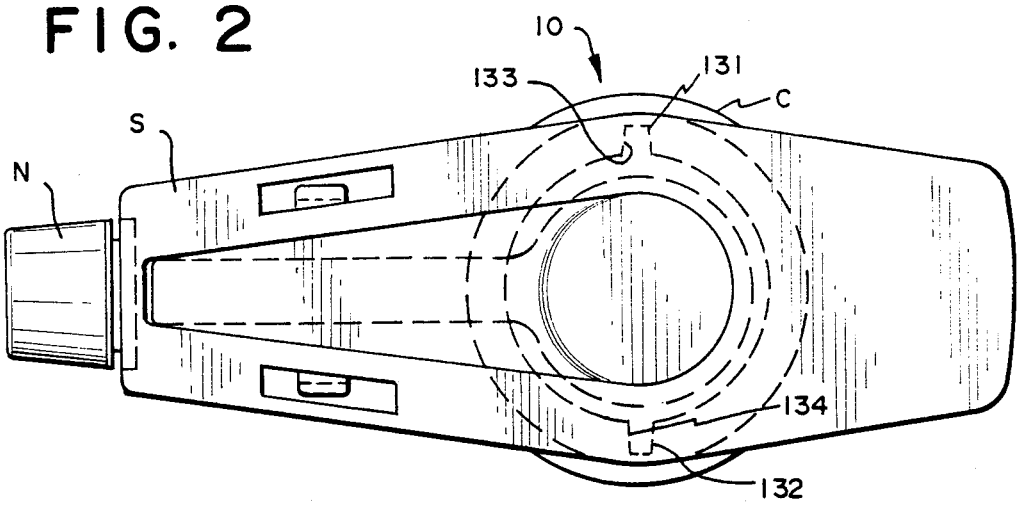
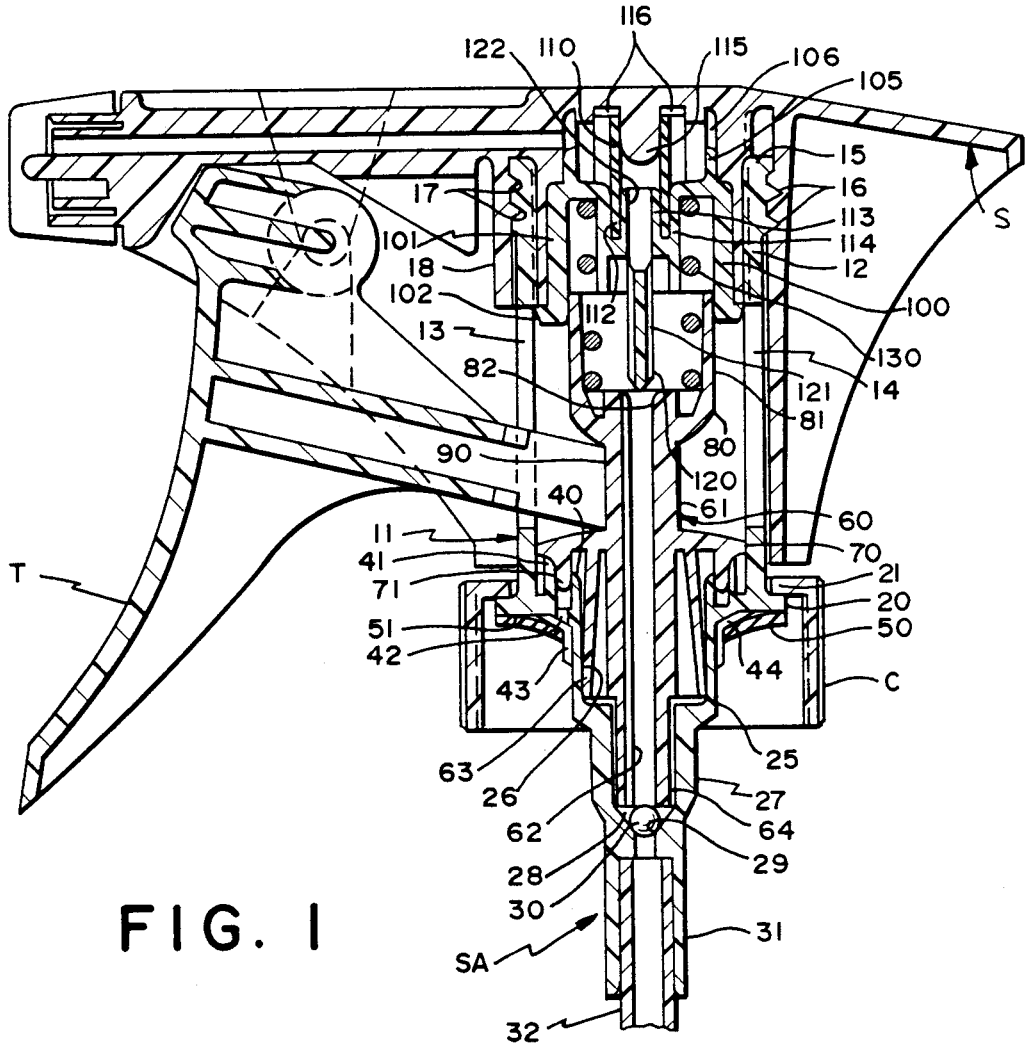
FIG. 1

FIG. 9
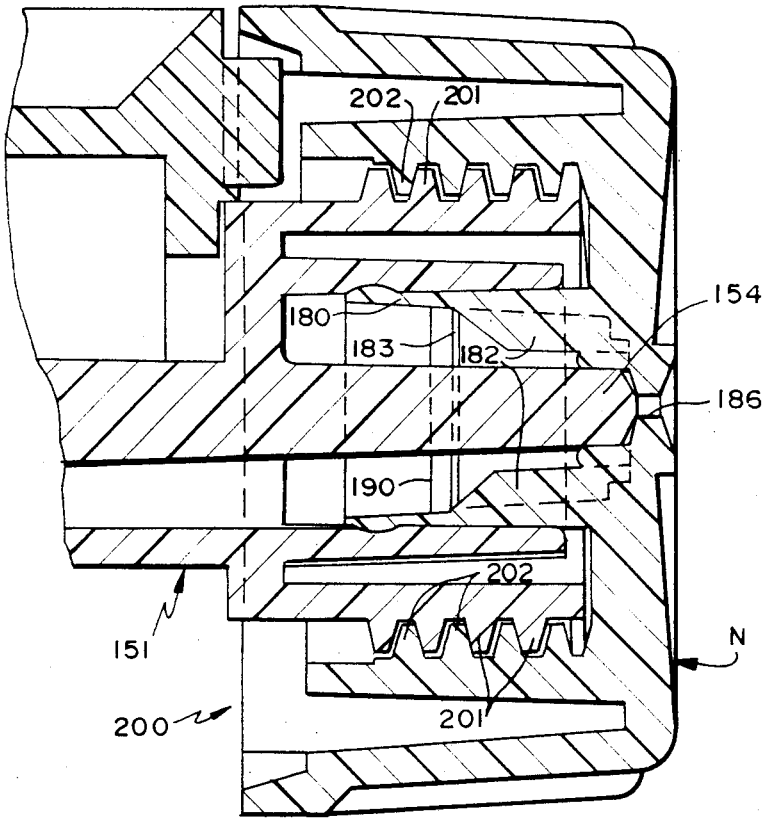
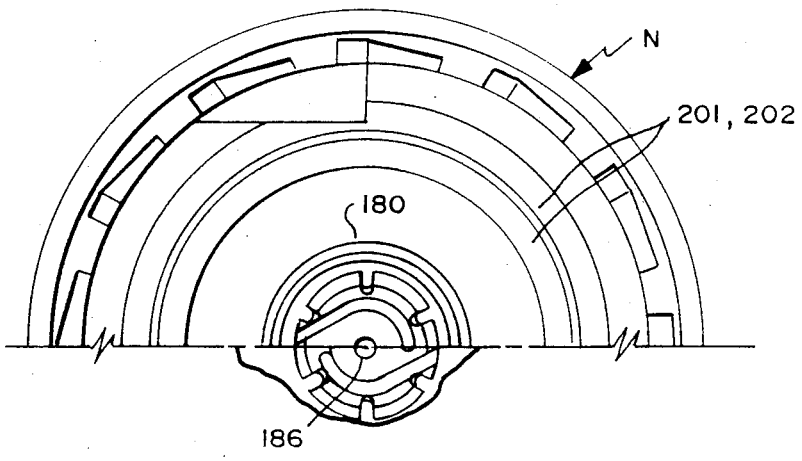
FIG. 10

TRIGGER SPRAYER

This is a continuation of co-pending application Ser. No. 194,296, filed on May 16, 1988, now abandoned.

FIELD OF THE INVENTION

This invention relates to fluid dispensing pumps of the type which are applied to a container and manually operated to dispense product from the container. More particularly, the invention relates to a triggeractuated pump having improved valving and nozzle configurations.

PRIOR ART

Many different pump constructions are known in the prior art for dispensing a variety of products, including various finger operated pumps and trigger sprayers. Such prior art pumps typically comprise a combination of molded plastic and rubber parts, steel ball valves and springs. In some constructions, a dip tube extends from adjacent the bottom of the container to a connection on the pump assembly, and when the pump is operated the dip tube moves with the pump. Further, the pump chamber and valving in most prior art pump constructions enable product to be dispensed by a relatively small and/or slow force applied to the actuator, as by a child, for example.

Additionally, many prior art pumps require complicated and expensive assembly, and large numbers of relatively small parts must be inventoried . Also, the use of molding techniques limits the materials which can be used in some parts of prior art pumps. Further, the type of construction used in most prior art pumps limits their strength, making them especially susceptible to breakage.

Examples of some prior art pump constructions are shown in the following U.S. Pat. Nos.: 3,768,734, 3,820,721, 3,840,157, 4,155,487, 4,227,650, 4,361,256 and 4,618,077. Each of these patents possesses one or more of the disadvantages described above, and is thus subject to improvement in spite of the relatively sophisticated structures shown and described therein. For instance, these patents variously utilize rubber bladders and valves, expensive steel ball check valves, relatively weak attachments to subassemblies and containers, and/or require complicated and expensive assembly. Moreover, the parts making up the various pumps disclosed in these patents must be individually inventoried for subsequent assembly into a completed pump upon order from a customer.

SUMMARY OF THE INVENTION

Accordingly, it is an object of the present invention to provide a pump which is simple and economical in construction.

Another object of the invention is to provide a pump which may be partially assembled to form at least one subassembly that may be inventoried for subsequent assembly with a minimum number of parts to form a completed pump.

A further object of the invention is to provide a pump which is constructed such that substantially all of the moving parts comprising the pump may be assembled to form a subassembly that may be inventoried as such for later use with various shroud and closure designs as specified by customers.

Yet another object of the invention is to provide a pump in which extruded plastic parts are used in the nozzle, enabling synthetic plastic materials to be used.

Another object is to provide a manually operated pump which includes a flow restrictor between the pump inlet and outlet chambers, rendering it child resistant.

A further object is to provide a manually operated pump having dual chambers connected through a passage controlled by a flow restrictor, requiring relatively rapid movement of the actuator to effect a dispensing cycle.

An even further object of the invention isto provide a pump in which the pump assembly and shroud have interfitting means to prevent relative rotational and lateral movement therebetween.

A still further object of the invention is to provide a trigger operated dispensing pump in which the components of the pump may be assembled in different rotational orientations, thereby minimizing alignment problems during assembly.

Another object of the invention is to provide a trigger operated dispensing pump in which the dip tube is connected to the pump chamber in such a way that the dip tube remains stationary upon operation of the pump.

A further object of the invention is to provide a filter means between the outlet valve and nozzle of the dispensing pump to filter particulate matter from the product being dispensed and prevent blockage of the nozzle.

A still further object of the invention is to provide an extruded outlet valve of tubular configuration, having one end sealed to the pump to receive product therefrom and the other end flexibly engaged on a valve seat protrusion, whereby pressurized product from the pump causes the outlet valve to unseat and enable flow of product to the nozzle.

These and other objects and advantages of the invention are achieved by the unique trigger operated, dual function pump of the invention, in which the pump subassembly comprises a generally cylindrical housing having a double ended piston reciprocable therein and defining an inlet chamber and an outlet chamber.

A unique extruded outlet valve is interposed between the outlet chamber and an outlet nozzle, and is opened by the pressure of the fluid being dispensed upon operation of the pump. The outlet valve comprises an elongate, cylindrical tube having one end sealed to the pump to receive product from the outlet chamber and the other end seated on a valve seat protrusion.

Filter means is interposed between the outlet valve and the nozzle for filtering particles from the product to prevent blockage of the nozzle by the particles. In a preferred form, the filter means comprises a plurality of restricted cross-section flow passages formed in the body of the pump or in the shroud adjacent the outlet from the outlet valve.

A flow restrictor is disposed between the inlet and outlet chambers, operable to admit flow from the inlet chamber to the outlet chamber upon an intake stroke and to prevent substantial reverse flow between the chambers upon normal actuation of the pump for a dispensing cycle. However, slow actuation of the pump, as might be effected by a child, for example, enables the fluid in the outlet chamber to follow the path of least resistance, i.e., past the restrictor and into the inlet chamber rather than through the outlet valve. Moreover, the outlet chamber is larger in volume than the inlet chamber, whereby the pump actuator will not become hydraulically locked in midstroke. Any additional demand for fluid in the outlet chamber is satisfied from the container.

The entire pump assembly, including the cylinder housing, double-ended pump, flow restrictor, dip tube, inlet valve and outlet valve may be pre-assembled to form a subassembly that can be inventoried and later used to fit a variety of shroud, trigger and closure designs as might be required by individual customers. Preferably, however, the outlet valve is left off the subassembly until final assembly of the dispensing pump is accomplished.

The cylinder housing has means for interfitting engagement with means on the shroud to prevent relative movement between the pump assembly and shroud, thereby assuring continued proper alignment of the trigger, and the cylinder housing may have a relatively strong flange formed thereon for cooperation with the closure to define a strong structure.

Several different extruded plastic nozzle outlet valves are provided, including: a push-pull arrangement in which the nozzle has either an "on" or an "off" position; a threaded "indexing" arrangement with "on", "off" and "intermediate" positions; and an arrangement in which a double ended nose piece valve cooperates with a flexible sleeve valve to control flow through the nozzle.

BRIEF DESCRIPTION OF THE DRAWINGS

The foregoing and other objects and advantages of the invention will become apparent from the following detailed description when considered with the accompanying drawings, in which like reference characters designate like parts throughout the several views, and wherein:

FIG. 1 is a longitudinal vertical sectional view of a trigger actuated pump in accordance with the invention, taken along line 1—1 in FIG. 2;

FIG. 2 is a top plan view of the trigger of FIG. 1;

FIG. 9 is an enlarged, vertical, fragment sectional view of the nozzle portion of the trigger pump, showing a second modification of the nose valve;

FIG. 10 is a rear end view of the nozzle of FIG. 9;

DETAILED DESCRIPTION OF THE PREFERRED EMBODIMENTS

Figure 3:
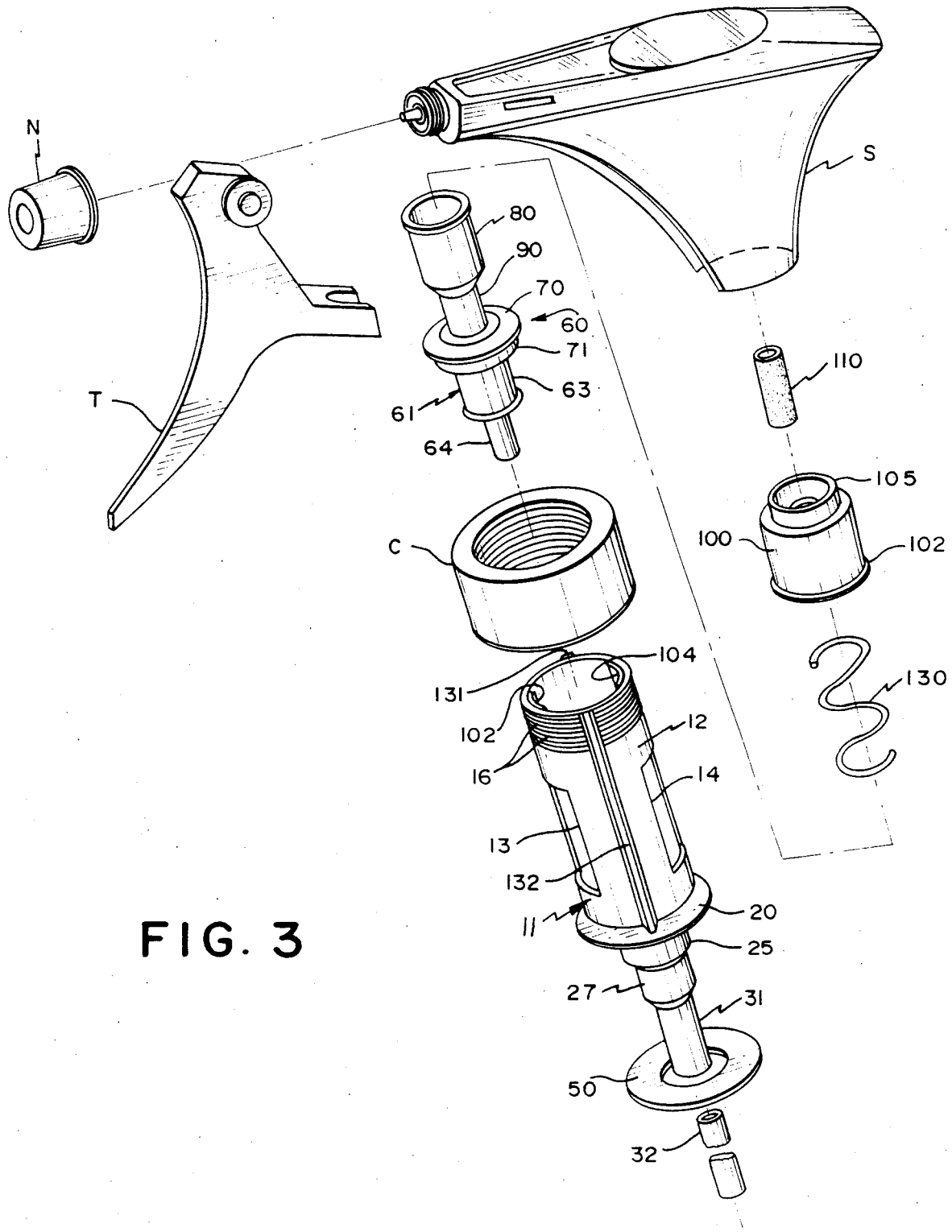
FIG. 3 is an exploded perspective view of the trigger of FIG. 1.
Figure 5:
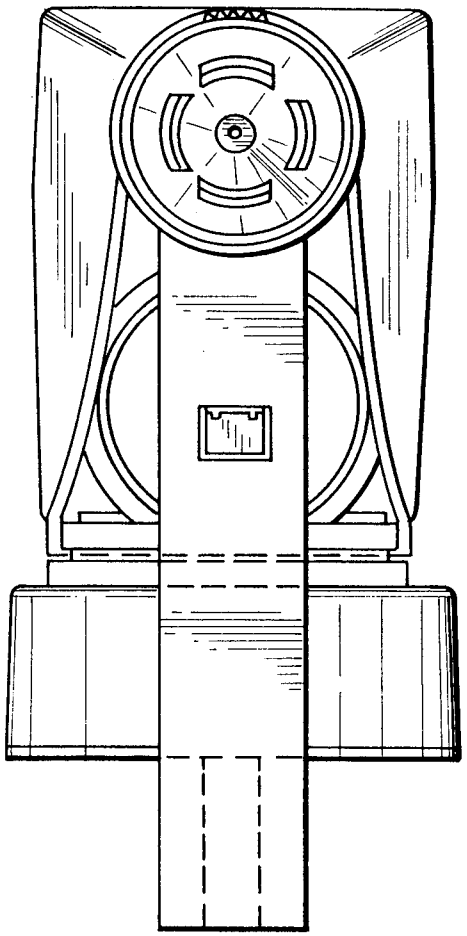
FIG. 5 is an end view of FIG. 4.
Figure 4:
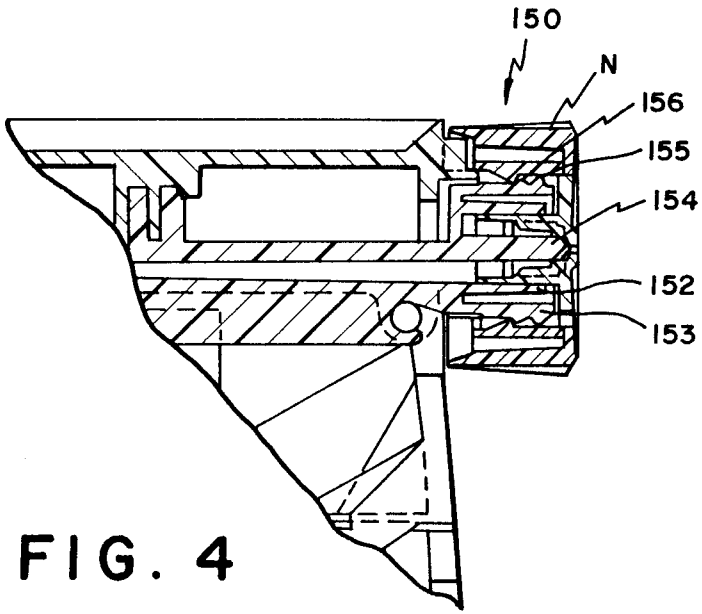
FIG. 4 is a fragmentary sectional view of the nozzle portion of the trigger pump, showing a first modification of the nose valve.

With more specific reference to the drawings, a first form of trigger actuated dispenser pump according to the invention is indicated generally at 10 in FIGS. 1-3. The trigger pump comprises a pump body or housing 11 having a generally cylindrically shaped upper end 12 with elongate openings 13 and 14 in diametrically opposite sides thereof and an open end 15. The outer surface of the body at the open end has one or more annular ribs 16 thereon for snap-fitting engagement with complemental ribs 17 on a depending skirt 18 of shroud "S", described more fully hereinafter.

An annular, radially outwardly extending flange 20 is formed on the body spaced below the openings 13 and 14 for cooperation with the lip 21 on a closure "C" to secure the pump to a container (not shown)

The body includes a reduced diameter portion 25 extending below the flange 20, defining a lower pump chamber or inlet chamber 26. A further reduced diameter portion 27 extends below the inlet chamber and defines an inlet valve chamber 28 with a seat 29 and ball check valve 30 therein. An extended tail piece 31 projects downwardly from the inlet valve for receiving the upper end of a dip tube 32.

A pair of upstanding, spaced apart, cylindrical walls 40 and 41 are formed in the body at the upper end of the inlet chamber 26, and a vent opening 42 extends through the body in the area between the walls 40 and 41. At least one rib 43 is formed on the outer surface of the body at the juncture between the end portion 12 and reduced diameter portion 25, defining at least one flow channel 44 for the vent.

An annular, resilient gasket 50 is positioned beneath the axially downwardly facing surface 51 defined at the juncture between the upper body portion 12 and lower body portion 25, for effecting a seal between the closure and pump housing 11 and the container (not shown) on which the pump is mounted. The channel 44 provides a path around the gasket for venting the container through the opening 42 during use of the pump, as described hereinafter.

A double ended, dual function piston 60 is reciprocably mounted in the housing 11, and includes an elongate body 61 having a passage 62 extending axially therethrough. A first, lower piston skirt 63 is formed on the body 61 between the ends thereof, whereby the body has a tail piece 64 extending downwardly below the piston skirt 63 and slidable in the inlet valve chamber 28 above the inlet ball valve 30. The piston skirt is slidably sealed in the lower or inlet chamber 26. The tail piece 64 has at least one axial channel or flow passage 65 on its outer surface, or, alternatively, in the wall of the inlet chamber 26, whereby fluid is enabled to flow from the dip tube, past the ball valve 30 and around the tail piece and into the inlet chamber 26 in the space beneath the piston skirt 63.

A diametrically enlarged flange 70 is formed on the outer surface of the piston body 61 at the upper end of the skirt 63, and has a downturned lip 71 on its outer periphery adapted to extend into the space between the spaced apart upstanding walls 40 and 41 to close off and seal the vent opening 42 when the piston is in its atrest position as shown in FIG. 1.

Both the tail piece and the flange 70 assist in preventing cocking of the piston in the housing during operation thereof.

An upper piston 80 is formed on the upper end of the body 61, and comprises an upwardly open cylindrical wall 81. A reduced diameter opening 82 is formed in the bottom central portion of the upper piston, in registering alignment with the passage 62 extending through the piston body 61.

The upper piston 80 and flange 70 define a narrowed waist portion 90 on the outer surface of the body 61, for cooperation with a trigger actuator "T" to reciprocate the piston.

An upper cylinder sleeve and outlet valve retainer 100 is secured in the open upper end of the housing 11, and comprises a depending skirt 101 with an outwardly directed foot flange 102 on the bottom edge thereof for snap-fitting engagement below a pair of lugs 102 and 104 formed on the inside surface of housing 11 above the openings 13 and 14. An upstanding, cylindrical sealing flange 105 is formed on the top of the retainer 100 for sealing engagement in an annular channel 106 on the underside of the shroud.

A cylindrical, extruded plastic outlet valve 110 is secured at a lower end thereof in the annular space 112 defined between a pair of spaced apart, concentric cylindrical walls 113 and 114 formed in the cylinder sleeve and outlet valve retainer 100 The upper end of the outlet valve 110 is engaged over a depending pin on the underside of the shroud "S", defining an outlet valve seat 115.

In the particular form of the invention shown, a plurality of restricted cross-section flow passages 116 are formed in the underside of the shroud at the outlet from the outlet valve 110, and define a filter means for removing particles from the product being dispensed and thereby prevent blockage of the nozzle by the particles.

A flow restricting pin or needle valve 120 is formed in the center of the cylinder sleeve and outlet valve retainer 100, and depends therefrom to closely adjacent the opening 82 in the piston. At least one axial flow passage 121 is formed in the outer surface of the pin 120 for restricted flow past the pin when it is extended into the opening 82. An outlet flow passage 122 is formed through the retainer coaxially with wall 114 for flow of fluid into the space enclosed by outlet valve 110.

Coil spring 130 is engaged between the retainer 100 and upper piston 80 to urge the piston and retainer apart in the housing 11 and maintain the parts in the position shown in FIG. 1.

Thus, the housing 11, inlet ball valve 30, piston 60, retainer sleeve 100 and spring 130 may all be assembled together to form a subassembly "SA" for inventory and later assembly with a shroud "S", closure "C" and trigger "T". In this way, essentially all of the pump components may be supplied as a unit for assembly with a shroud, closure and trigger of a customer's design or specification.

Further, as seen best in FIGS. 2 and 3, a pair of elongate ribs 131 and 132 are formed on the outside of the body 11 for complemental engagement in a pair of channels 133 and 134 formed in the inner surface of the shroud "S" to prevent turning of the shroud relative to the pump assembly, thus strengthening the dispenser of the invention in comparison with prior art pumps. In addition, the flange 70 on the housing 11 may be made as thick and strong as desired for cooperation with the closure "C" to form a strong connection with the container.

The housing 11, piston 60, outlet valve 110 and sleeve retainer 100 may be secured together in any rotational position about their longitudinal axes, except that the housing 11 must be oriented in either of two rotational positions 180° apart about its longitudinal axis so that the trigger actuator can have access to the piston through one of the openings 13 and 14. This considerably simplifies assembly of the pump components.

In use, the pump components are initially in the at-rest position shown in FIG. 1, with the inlet valve 30 and outlet valve 110 closed, and lip 71 sealing the vent opening 42. When the trigger is operated, the piston 60 is moved upwardly, whereby the lower piston skirt 63 enlarges the lower pump chamber, drawing product upwardly through the dip tube and into the space beneath skirt 63. When the trigger is released, the spring forces the piston back down to the position shown in FIG. 1, forcing product up through the passage 62 and into the upper pump chamber defined by piston wall 81 and retainer sleeve 100. When the trigger is again depressed to raise the piston, the product is pressurized, overcoming the bias of outlet valve 110 and flowing to and through the nozzle "N". The pin 120 extends into the opening 82 in the piston to restrict flow of the product back into the lower pump chamber. However, if the trigger is depressed slowly, the restriction to flow offered by the pin is less than the resistance offered by the outlet valve, and flow will occur back into the inlet chamber rather than through the outlet valve. This action comprises a child safety feature.

Since the outlet valve is extruded rather than molded, various synthetic plastic materials, as well as various rubber compounds can be used.

When it is desired to assemble the pump assembly with a shroud and trigger, a closure "C" may be simply slipped over the end of the assembly and into engagement with the flange. The assembly may then be snapped into a shroud (with a trigger being provided) to complete the assembly of the trigger actuated dispenser pump.

A first modification of the invention is shown in FIGS. 4–8, and comprises a push-pull nose valve or nozzle arrangement 150. In the form shown, the shroud includes a nose piece 151 having concentric, forwardly projecting cylindrically shaped walls 152 and 153 with a central valving pin 154 extending forwardly concentric with the walls. The outer wall 153 has a pair of axially spaced ramps 155 and 156 molded thereon adjacent the outer end of the wall. As seen best in FIG. 6, the axially outwardly facing surfaces 157 and 158 of these ramps slope rearwardly at a relatively shallow angle. The rear face 159 of the outer ramp 156 is relatively steep, defining a stop, while the rear face 160 of ramp 155 is gently rounded. Further, the forward or outer ramp 156 has a greater height or radial dimension than the rearward ramp 155.

The nozzle "N" is formed with an outer cylindrical wall 170 projecting rearwardly generally concentrically over the nose piece, and is preferably formed with a roughened outer surface 171 to facilitate manipulation of the nozzle. A cylindrical skirt 172 projects rearwardly in concentric, radially inwardly spaced relationship to the wall 170, and has a plurality of circumferentially spaced lugs 173 formed on its inner surface for cooperation with the ramps on the wall 152. The lugs 173 have a relatively gently sloping rear facing surface 174 and a steeper front facing surface 175. A third cylindrical wall 180 projects rearwardly from the center of the nozzle in concentric relationship with the walls 170 and 172, and has a raised annular sealing bead 181 on the outer surface of the rearward end thereof for sealing, sliding engagement with the inner surface of the wall 153 on the nose piece 151. The inner surface of wall 180 has a plurality of axially elongate, radially inwardly extending flanges 182 formed thereon, with an annular sealing shoulder 183 at the rearward end of the flanges.

Moreover, the rearward ends of the flanges are sloped forwardly as at 184, for a purpose later described.

A cylindrical pocket 185 is formed in the end of the nozzle on the rear surface thereof for engagement over the end of the pin 154. An outlet opening 186 is formed through the end of the nozzle, and when the nozzle is in its inner position shown in FIG. 6, the end of the pin 154 seals against the nozzle at the bottom of the pocket 185, closing the opening 186 to flow.

Figure 6:
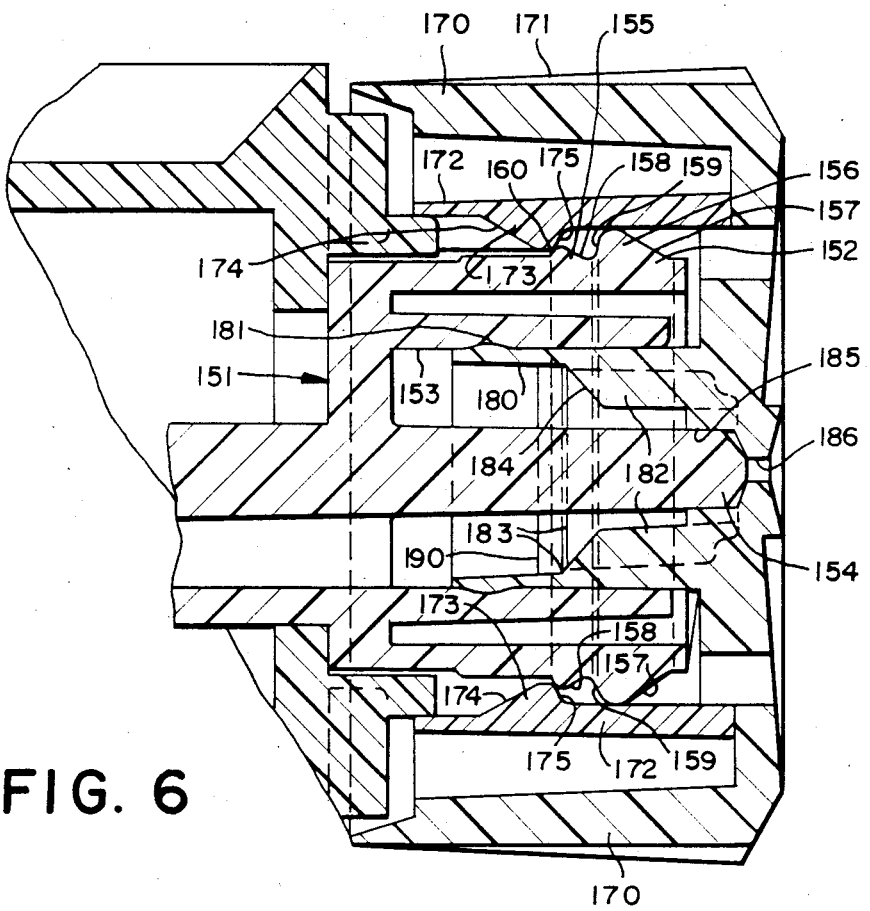
FIG. 6 is an enlarged, vertical, fragmentary sectional view of the nose valve arrangement of FIG. 4.
Figure 7:
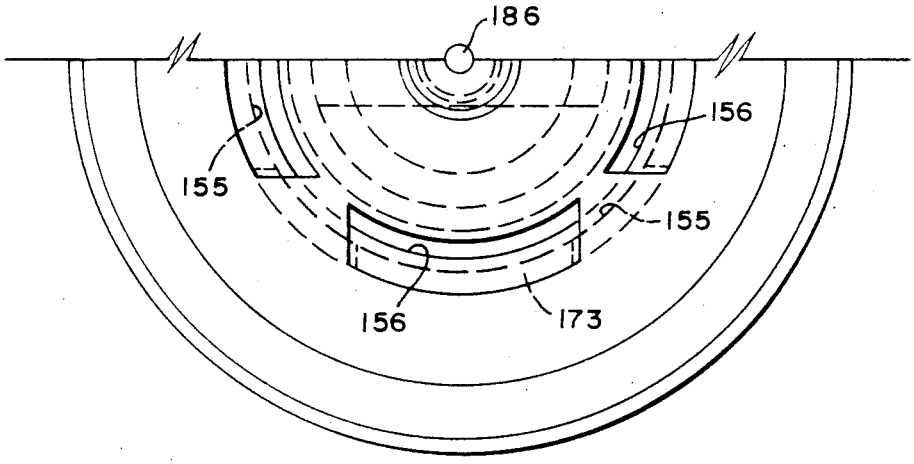
FIG. 7 is a front end view of the nozzle of FIG. 6.
Figure 8:
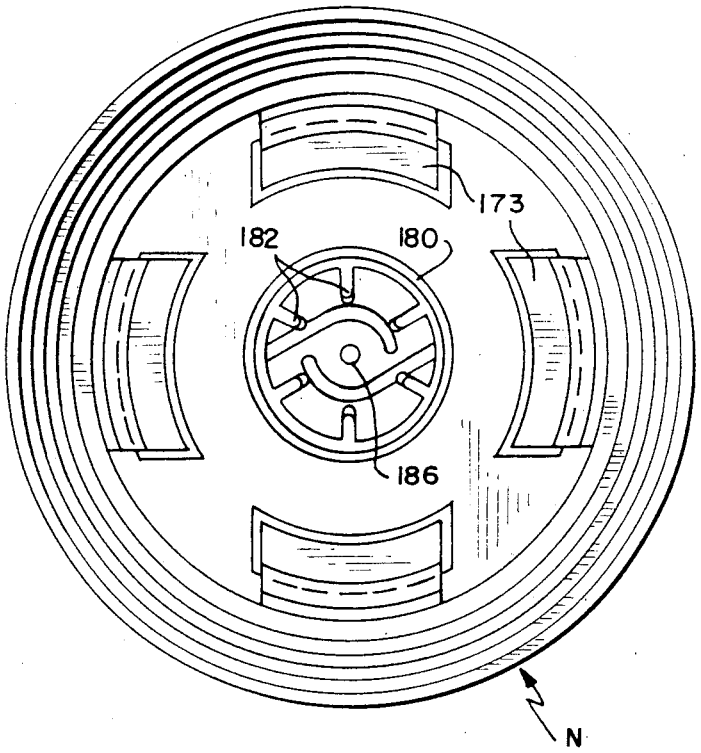
FIG. 8 is a rear end view of the nozzle of FIG. 6.

A further seal is provided by a washer-like sealing gasket 190 sealingly engaged at its inner surface or diameter on the pin 154 and sealingly engaged at its outer surface or diameter against the annular sealing shoulder 183 in the nozzle, when the nozzle is in the position shown in FIG. 6.

The nozzle is assembled to the nose piece by pushing it axially rearwardly over the nose piece until the lugs 173 ride over the ramps 155 and 156 to the position shown in FIG. 6, with the sealing gasket 190 engaged between the pin and the nozzle as described above. The rear ramp 155 is the operative ramp with the lugs 173, determining the "on" and "off" positions of the nozzle, i.e., when the nozzle is pushed rearwardly to pass the lugs 173 rearwardly over the ramp 155, the nozzle is in its "off" position, while when the nozzle is pulled forwardly to cause the lugs 173 to ride up and over the ramp 155, the nozzle is in its "on" position. The relatively steep rear surface of the ramp 156 defines a stop to prevent the nozzle from being moved axially off of the nose piece.

As can be seen in FIG. 6, when the nozzle is in its rearward "off" position, the end of pin 154 is engaged against the nozzle at the bottom of the pocket 185, closing the opening 186, and the sealing gasket 190 is sealed against both the pin 154 (at the inner diameter of the gasket) and the sealing shoulder 183 (at the outer diameter of the gasket).

When it is desired to effect dispensing of product, the nozzle is moved or pulled to its forward position, with the lugs 173 engaged against the stop defined by ramp 156, and the end of pin 154 disengaged from the nozzle. The trigger is then operated to pressurize product and cause it to flow outwardly, either through the outlet valve 110 or another outlet valve, or from the outlet chamber directly into passage 185 in the nose piece. The pressure of the product causes the gasket 190 to buckle or deform forwardly against the tapered ends of the flanges 182, lifting the outer diameter away from the sealing shoulder 183 and enabling flow of product through the passages defined by the flanges 182 and thence through the opening 186 in the nozzle.

A variation of this form of the invention is shown at 200 in FIGS. 9 and 10, wherein mating screw threads 201 and 202 are formed on the nozzle and nose piece, respectively, whereby the nozzle may be moved through "intermediate" positions between its forward-most full "on" position and its rearward-most "off" position. In all other respects, this form of the invention functions the same as that shown in FIGS. 4–8.

Figure 11:
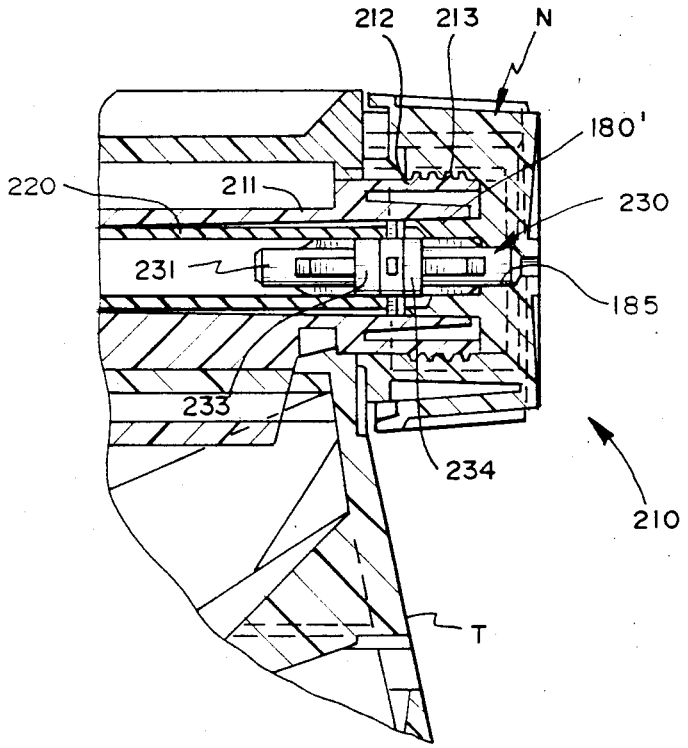
FIG. 11 is an enlarged, fragmentary vertical sectional view through the nose portion of the trigger pump, showing a third modification of the nose valve.
Figure 13:
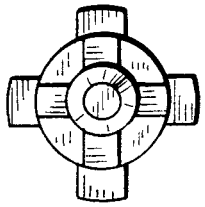
FIG. 13 is an end view of the nose piece valve of FIG. 12.
Figure 12:
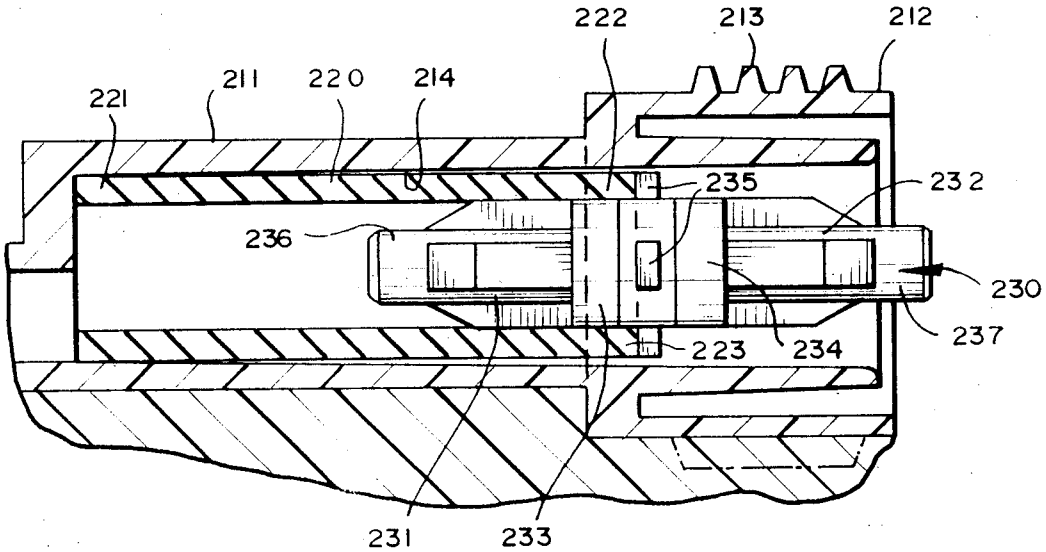
FIG. 12 is a further enlarged, fragmentary sectional view of the nose valve of FIG. 12, with portions removed for the sake of clarity.

A further nozzle valve arrangement is shown at 210 in FIGS. 11–13. In this form of the invention, the nose piece is formed with a forwardly extending tubular projection 211 having a skirt 212 concentric with the forward end thereof and externally threaded at 213. The bore 214 through the tubular projection has a slight taper opening toward the forward or outer end thereof.

An elongate, cylindrical, extruded valve sleeve 220 is received in the bore 214, and as seen best in FIG. 12 is in snug, sealing engagement with the bore at its inner end 221. However, the forward or outer end 222 of the valve sleeve 220 is spaced radially inwardly from the bore. The forward end 222 also terminates short of the forward end of the bore 214, defining a stop surface 223.

A symmetrically shaped, double-ended nose piece valve 230 is seated in the forward end of the nose piece, and has a fluted end 231 extending rearwardly into the valve sleeve 220 and a fluted end 232 extending forwardly into the central cylindrical wall 180, on the nozzle. In this form of the invention, the wall 180, does not have the axially elongate flanges therein. Instead, the fluted end of the nose piece valve provides the necessary flow passages between the valve and the wall. The central portion of the valve includes a pair of smooth and uninterrupted sealing surfaces 233 and 234 for sealing engagement against the inner surface of the valve sleeve (the nose piece valve, being symmetrical, can be oriented with either end disposed inwardly). A plurality of radially outwardly protruding stop lugs 235 are formed at the center of the valve for engagement against the end stop surface 223 on the end of the valve sleeve.

When the nozzle is threaded rearwardly onto the nose piece, the end 236 (or 237, depending upon the end-for-end orientation of the valve) engages in the pocket 185 on the nose piece and closes the opening 186. When it is desired to dispense product, the nozzle is moved outwardly on the nose piece, unseating the nose piece valve from the nozzle, and the trigger is actuated to force product under pressure forwardly into the sleeve 220. The pressure of the product causes the sleeve to flex outwardly away from the sealing area 233 (or 234) on the valve, enabling flow through the nozzle. The tapered bore 214 provides the requisite clearance for the sleeve.

Any of the nose piece valving arrangements described herein may be used with the unique dual function trigger actuated dispenser pump of the invention, or with other dispenser pumps.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. A dispenser pump to be mounted on a container for dispensing product from the container, comprising:

a pump housing having first means at one end defining an inlet chamber and second means at the other end defining an outlet chamber;

said first means including first movable means in the inlet chamber for alternately enlarging and decreasing the volume of the inlet chamber, and said second means including a second movable means in said outlet chamber for alternately enlarging and decreasing the volume of the outlet chamber;

means connected with said inlet chamber for flow of product into said inlet chamber from a container on which said pump is mounted;

flow passage means for flow of product from the inlet chamber to the outlet chamber;

retaining means engaged in said other end of the housing for retaining the first and second means in the housing;

said housing, said first and second movable means, said retaining means and said flow passage means comprising a subassembly which may be preassembled and inventoried for subsequent assembly with a container and actuator;

actuator means connected with said first and second movable means to move them together to pump product into the inlet chamber, from the inlet chamber to the outlet chamber and from the outlet chamber to be dispensed;

outlet valve means openable for flow of product from the outlet chamber when a predetermined pressure is reached in the outlet chamber; and restrictor means in said flow passage means for restricting flow of product from the inlet chamber to the outlet chamber, whereby relatively slow movement of said first and second movable means in a direction to pressurize and dispense product from the outlet chamber results in flow of product from the outlet chamber to the inlet chamber, and relatively rapid movement of said first and second movable means in a direction to pressurize and dispense product from the outlet chamber results in opening of the outlet valve means and flow of product from the outlet chamber to be dispensed, said restrictor means thus providing a childsafety feature.

2. A dispenser pump as claimed in claim 1, wherein:

said housing is cylindrical in shape and has stop means in said other end;

said second means at said other end of said pump housing comprises an outlet valve retainer and cylinder sleeve inserted in said other end through the open end and having detent means engaged behind the stop means; and said first and second movable means comprise first and second pistons reciprocable in the inlet and outlet chambers, respectively.

3. A dispenser pump as claimed in claim 2, wherein:

said first and second pistons are formed on opposite ends of a piston body reciprocable in said housing, said second piston being reciprocable in said outlet valve retainer and cylinder sleeve.

4. A dispenser pump as claimed in claim 3, wherein:

said housing has snap detent means on said other end thereof for snap-fitting engagement with complemental snap-fitting means on a shroud, whereby said housing may be attached to a shroud for enclosing the pump.

5. A dispenser pump as claimed in claim 4, wherein:

said one end of said housing has attachment means thereon for securing the housing to a container.

6. A dispenser pump as claimed in claim 5, wherein:

said attachment means comprises a radially outwardly directed flange for cooperation with a closure adapted to be secured on a container.

7. A dispenser pump as claimed in claim 6, wherein:

said first piston comprises a downwardly and outwardly flared skirt sealingly slidable in said inlet chamber; and said second piston comprises an upwardly open cylindrical wall sealingly slidable in said outlet valve retainer and cylinder sleeve.

8. A dispenser pump as claimed in claim 7, wherein:

said piston body has a reduced diameter waist between said first and second pistons, defining an actuator-engaging means for reciprocating said piston body.

9. A dispenser pump as claimed in claim 8, wherein:

said housing has openings in the side thereof between the ends, providing access openings for an actuator to engage the waist of the piston body to reciprocate the pistons, said openings providing access for said actuator to said piston in either of two rotational positions of said housing in the dispenser pump.

10. A dispenser pump as claimed in claim 9, wherein:

said flow passage means comprises an axial bore through the piston body, opening centrally in the bottom of said wall defining said second piston; and said restrictor means comprises an elongate pin or needle valve depending from the outlet valve retainer and cylinder sleeve into aligned proximity with said opening, whereby when said piston body is reciprocated toward said other end of said cylinder, the needle valve extends into said opening and flow passage to restrict flow therethrough.

11. A dispenser pump as claimed in claim 10, wherein:

said piston body is resiliently biased toward said one end of the housing by a coil spring engaged between said second piston and said outlet valve retainer and cylinder sleeve.

12. A dispenser pump as claimed in claim 1, wherein:

said outlet valve comprises an extruded cylindrical plastic sleeve fixed at one end in fluid communication with a flow passage leading from the outlet chamber, and engaged at its other end over a protrusion defining a seat, said sleeve being yieldable to deflect radially away from the seat to enable flow upon pressurization of fluid in the outlet chamber.

13. A dispenser pump as claimed in claim 11, wherein:

the piston body has an axially extended tail piece projecting below said first piston, said tail piece being slidable in an inlet valve chamber formed in the housing; and a one-way inlet check valve in said inlet valve chamber for seating against flow of product from the inlet chamber back into the container.

14. A dispenser pump as claimed in claim 3, wherein:

a vent opening is formed through said housing at said one end for venting a container on which said pump is adapted to be mounted; and a depending annular sealing skirt is formed on the piston body in position to close the vent opening when the piston body is at rest, and to open the vent opening during a dispensing cycle.

15. A dispenser pump as claimed in claim 1, wherein:

said housing has an axially extending, depending tail piece for receiving and holding a dip tube for conveying product from a container into the inlet chamber, whereby the dip tube does not move upon actuation of the pump.

16. A dispenser pump as claimed in claim 1, wherein:

spring means is engaged between the retaining means and the first and second movable means for urging the first and second movable means in a direction to enlarge the outlet chamber and decrease the inlet chamber.

17. In a dispensing pump including a body with a nose piece having a forward end, a flow passage through the nose piece for product to be dispensed, and an adjustable nozzle carried on the nose piece for controlling flow from the passage and through the nozzle, the improvement comprising:

an elongate, axially projecting valving pin on the forward end of the nose piece;

first and second concentrically spaced cylindrical walls formed on the nose piece and extending forwardly coaxially with the valving pin, one of said walls having nozzle adjustment means thereon and the other of said walls having a smooth sealing surface;

said nozzle having a rearwardly extending cylindrical skirt with nozzle adjustment means thereon for cooperation with the adjustment means on the nose piece to hold the nozzle in different adjusted positions on the nose piece to control flow from the nozzle, said nozzle having a dispensing passage therethrough and said valving pin having an end portion engageable with the nozzle to close the passage in one position of the nozzle on the nose piece, and said nozzle having a rearwardly extending cylindrical wall with a sealing ring slidably engaged with the smooth sealing surface on the nose piece to seal the nozzle with respect to the nose piece; and a flexible valving member engaged between the valving pin on the nose piece and the cylindrical wall on the nozzle, said valving member being normally closed and being openable by fluid pressure acting thereon to enable flow through the nozzle.

18. A dispensing pump as claimed in claim 17, wherein:

the rearwardly extending cylindrical wall on the nozzle has an annular sealing shoulder on an inner surface thereof, said wall being radially spaced outwardly from the valving pin on the nose piece; and said valving member comprises a washer-like member having an inner diameter engaged on the valving pin and an outer diameter engaged against the sealing shoulder on the nozzle.

19. A dispensing pump as claimed in claim 18, wherein:

a plurality of axially elongate, radially inwardly projecting flanges or flutes are formed on the inner surface of said cylindrical wall of the nozzle, said flanges terminating at the sealing shoulder and defining a stop against which the washer-like valving member abuts, said stop being inclined to the axis of the valving pin, whereby the washer-like valving member is caused to dish or buckle under the influence of fluid pressure thereon and to lift at its outer diameter from the sealing shoulder to enable flow therepast.

20. A dispensing pump as claimed in claim 19, wherein:

said nozzle adjustment means on said one wall of the nose piece comprises a plurality of axially spaced ramps; and the nozzle adjustment means on the skirt of the nozzle comprises a detent engageable with the ramps so that the detent is enabled to ride forward and backward over one of the ramps, establishing "on" and "off" positions for the nozzle, and another of said plurality of ramps comprises a stop to limit forward movement of the nozzle on the nose piece, whereby said nozzle has a "push-pull" actuation.

21. A dispensing pump as claimed in claim 19, wherein:

the nozzle adjustment means comprises interengaged screw threads on the nozzle skirt and said one wall of the nose piece, whereby the nozzle may be adjusted through intermediate positions between "on" and "off" positions.

22. In a dispensing pump including a body with a nose piece having a forward end, a flow passage through the nose piece for product to be dispensed, and an adjustable nozzle carried on the nose piece for controlling flow from the passage and through the nozzle, the improvement comprising:

an elongate, forwardly projecting cylindrical body on the nose piece, said body having a central bore extending axially therethrough;

means on a forward end of the body for adjustable attachment of the nozzle;

a flexible, elongate, cylindrical nose piece valve sleeve engaged in said central bore; and an elongate, double-ended nose piece valve having one end received in one end of said sleeve and the other end adapted to engage against the nozzle to preclude flow through the nozzle, said one end of said sleeve normally being sealingly engaged against said one end of said nose piece valve but being flexibly movable away from said nose piece valve under the influence of fluid pressure therein to enable flow past said nose piece valve and sleeve.

23. A dispensing pump as claimed in claim 26, wherein:

said double ended nose piece valve is symmetrically constructed, whereby it functions identically even if turned end-for-end.

24. A dispensing pump as claimed in claim 23, wherein:

said sleeve has a length shorter than the cylindrical body, whereby the end of the sleeve terminates short of the end of the bore; and said nose piece valve has stop means on a central portion thereof engageable with the end of the sleeve to limit axial movement of the nose piece valve.

25. A dispensing pump as claimed in claim 24, wherein:

the bore has a slight taper opening toward the forward end thereof, defining a clearance space for flexing movement of the sleeve away from the nose piece valve member.

26. In a dispensing pump to be mounted on a container for dispensing product from the container, including a pump means for pumping product from the container to dispense the product, a shroud for enclosing the pump means, a nozzle through which the product is dispensed, an outlet valve for controlling flow through the nozzle, and an actuator for operating the pump means, said pump means comprising:

a cylindrical housing having first and second ends, first means at the first end defining an inlet chamber and second means at the second end defining an outlet chamber;

attachment means on the second end for attachment of a shroud to the housing, and mounting means on the first end for mounting the housing to a container;

a double-ended piston body reciprocable in the housing and including a first piston reciprocable in the inlet chamber, a second piston reciprocable in the outlet chamber, and flow passage means for flow of product from the inlet chamber to the outlet chamber;

spring means engaged with the piston body, urging the piston body toward the first end of the housing;

said outlet chamber including an outlet valve retainer and cylinder sleeve snap-fitted in the second end of the housing for retaining the piston body and spring means assembled in the housing;

outlet valve means openable for flow of product from the outlet chamber when a predetermined pressure is reached in the outlet chamber; and restrictor means in said flow passage means for restricting flow of product from the inlet chamber to the outlet chamber, whereby relatively slow movement of said first and second movable means in a direction to pressurize and dispense product from the outlet chamber results in flow of product from the outlet chamber to the inlet chamber, and relatively rapid movement of said first and second movable means in a direction to pressurize and dispense product from the outlet chamber results in opening of the outlet valve means and flow of product from the outlet chamber to be dispensed, said restrictor means thus providing a childsafety feature;

said housing, piston body, sleeve and spring means comprising a pump subassembly which may be pre-assembled and inventoried for later assembly with an actuator and shroud to form a completed dispenser pump.

27. A dispenser pump as claimed in claim 26, wherein:

a filter means is between the outlet valve and the nozzle for filtering particles from the product before it reaches the nozzle to prevent blockage of the nozzle.

28. In a dispensing pump as claimed in claim 27, wherein:

the filter means comprises a plurality of restricted cross-section flow passages.

29. In a dispensing pump as claimed in claim 28, wherein:

the restricted flow passages are formed adjacent the outlet from the outlet valve.

30. In a dispenser pump as claimed in claim 27, wherein:

the piston body, sleeve and spring means may be assembled in any rotational position about their longitudinal axes, and the housing may be assembled in either of two rotational positions 180° apart.

31. In a dispenser pump as claimed in claim 30, wherein:

a vent opening is formed through the housing; and a vent valve is formed on the piston body in a position to close the opening when the piston body is at rest and to open the vent opening during a dispensing cycle.

32. In a dispenser pump as claimed in claim 31, wherein:

an extruded plastic outlet valve is attached to the housing.

33. In a dispenser pump as claimed in claim 32, wherein:

the housing includes a tail piece having means for attachment of a dip tube; and an inlet valve chamber containing an inlet valve between the tail piece and inlet chamber.

* * * * *

US004982900B1

REEXAMINATION CERTIFICATE (3504th)

United States Patent [19] [11] B1 4,982,900

Blake [45] Certificate Issued May 5, 1998

[54] TRIGGER SPRAYER

[76] Inventor: William S. Blake, 14 Georgetown Ct., Linwood, N.J. 08221

Reexamination Request:
No. 90/004,730, Aug. 22, 1997

Reexamination Certificate for:

| | |
|---|---|
| Patent No.: | **4,982,900** |
| Issued: | **Jan. 8, 1991** |
| Appl. No.: | **453,003** |
| Filed: | **Jan. 24, 1990** |

Related U.S. Application Data

[63] Continuation of Ser. No. 194,296, May 16, 1988, abandoned.

[51] Int. Cl.[6] ..... B05B 9/043

[52] U.S. Cl. ..... 239/333; 239/570; 239/575; 239/581.2; 222/383; 222/402

[58] Field of Search ..... 239/533.13, 570, 239/571, 333; 222/383

[56] References Cited

U.S. PATENT DOCUMENTS

| | | | |
|---|---|---|---|
| 384,306 | 6/1888 | Bardil | 239/533.3 |
| 2,715,980 | 8/1955 | Frick | 137/853 |
| 3,276,641 | 10/1966 | Lehmann | 222/384 |
| 3,632,042 | 1/1972 | Kirsh | 137/853 |
| 3,739,952 | 6/1973 | Chafitz et al. | 239/533.13 X |
| 3,804,302 | 4/1974 | Yamada et al. | 222/402.14 X |
| 3,827,638 | 8/1974 | Halvorsen | 239/533.13 |
| 4,034,900 | 7/1977 | Hafale | 239/333 |
| 4,161,288 | 7/1979 | McKinney | 222/385 X |
| 4,262,823 | 4/1981 | Monden | 222/321 |
| 4,345,718 | 8/1982 | Horvath | 234/333 |
| 4,361,256 | 11/1982 | Corsette | 222/383 |
| 4,530,449 | 7/1985 | Nozawa et al. | 222/402.14 X |
| 4,596,344 | 6/1986 | Corsette | 239/333 |
| 4,618,077 | 10/1986 | Corsette | 222/383 |
| 4,640,444 | 2/1987 | Bundschuh | 222/321 |
| 4,702,419 | 10/1987 | Luchsinger | 239/333 |

FOREIGN PATENT DOCUMENTS

| | | | |
|---|---|---|---|
| 569999 | 12/1944 | United Kingdom | 239/533.13 |

OTHER PUBLICATIONS

TS-800 Trigger Sprayer Fact Sheet, Calmar Inc., Oct. 1986.

*Primary Examiner*—Kevin Weldon

[57] ABSTRACT

A dual function trigger sprayer in which a pump housing is formed with fastening means thereon to secure the housing to a shroud, and has structure at opposite ends defining an inlet chamber and an outlet chamber, respectively. A double ended piston is reciprocable in the housing to effect dispensing of product from a container on which the sprayer is attached, and an outlet valve controls flow from the outlet chamber. A passageway extends through the piston to enable flow between the inlet and outlet chambers, and a restrictor is associated with the passageway to restrict flow between the chambers in such a way that a relatively slow actuation of the piston will result in product flowing from the outlet chamber back into the inlet chamber, defining a child safety feature. Relatively firm, rapid actuation of the piston, on the other hand, will cause the outlet value to open for dispensing of product. The housing, piston and restrictor may be preassembled as a subassembly for inventory and subsequent assembly with a shroud and actuator. Several unique nose piece valve constructions are also disclosed, and a filter is disposed between the outlet valve and the nozzle to filter particulate matter from the product to prevent blockage of the nozzle.

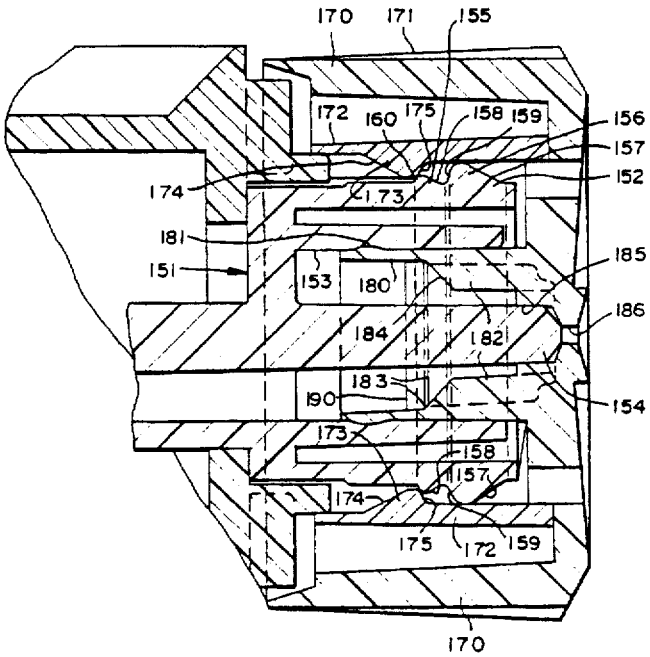

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–33 is confirmed.

* * * * *